US006880452B2

(12) United States Patent
Wiseman et al.

(10) Patent No.: US 6,880,452 B2
(45) Date of Patent: Apr. 19, 2005

(54) SPRING STANDOFF FOR A RECIPROCATING DEVICE

(75) Inventors: Robert B. Wiseman, Athens, OH (US); Reuven Unger, Athens, OH (US); David Weeks, Athens, OH (US); Floyd Largent, New Plymouth, OH (US); Woo Suk Chung, Kyunggi-do (KR)

(73) Assignees: LG Electronics Inc., Seoul (KR); Sunpower, Inc., Athens, OH (US)

( * ) Notice: Subject to any disclaimer, the term of this patent is extended or adjusted under 35 U.S.C. 154(b) by 2 days.

(21) Appl. No.: 10/627,715

(22) Filed: Jul. 28, 2003

(65) Prior Publication Data

US 2005/0022662 A1 Feb. 3, 2005

(51) Int. Cl.[7] ..... F01B 31/00
(52) U.S. Cl. ..... 92/130 R; 60/520

(58) Field of Search ..... 92/130 R; 60/520

(56) References Cited

U.S. PATENT DOCUMENTS 6,293,184 B1 * 9/2001 Unger ..... 92/153
6,446,336 B1 9/2002 Unger

* cited by examiner

*Primary Examiner*—Thomas E. Lazo
(74) *Attorney, Agent, or Firm*—Greenblum & Bernstein, P.L.C.

(57) ABSTRACT

A spring standoff for a reciprocating device, the standoff having a generally cylindrical body and having a window in a circumferential surface of the body, and a flange at each end of the body, one flange to be coupled to a planar spring of the reciprocating device, and the other flange to be coupled to a sealing container of the reciprocating device. The body generally concentrically houses at least a portion of a reciprocating rod coupled to the planar spring of the reciprocating device.

8 Claims, 2 Drawing Sheets

SPRING STANDOFF FOR A RECIPROCATING DEVICE

CROSS-REFERENCE TO RELATED APPLICATION

The present application is related to Korean Patent Application No. 2002-006327, filed on Feb. 4, 2002, the disclosure of which is expressly incorporated by reference in its entirety.

BACKGROUND OF THE INVENTION

1. Field of the Invention

The present invention relates to a spring fixing or securing part, and more particularly, to a spring standoff having an open central portion for improving the efficiency of the centering operation of a reciprocating rod displacer during an assembly process.

2. Description of the Related Art

Generally, a variety of reciprocating devices, including but not limited to free-piston machines, are often used in a heat regeneration type of refrigerator, including but not limited to Stirling coolers, Gifford-McMahon refrigerators, and the like.

A conventional free-piston machine is described in U.S. Pat. No. 6,293,184, which issued to Unger on Sep. 25, 2001, the contents of which are expressly incorporated by reference in its entirety. Additionally, hereinafter, the structure and operation of a conventional typical free piston machine is described in FIG. 1, which shows a sectional view of a typical free-piston machine. FIG. 2 is a perspective view of the conventional spring standoff.

The free-piston machine includes a sealing container 10, a cylinder 20 installed in the inside the sealing container 10 for containing a gas therein, a piston 22 mounted in the inside the cylinder 20, a displacer housing 30 provided on one side of the cylinder 20, a displacer 32 movably installed at the inside the displacer housing 30, for compressing and expanding the gas, a regenerator 40 for absorbing thermal energy from the gas, and a linear motor 50 for driving the piston 22.

The displacer 32 has a displacer rod 321 on one end. The displacer rod 321 penetrates the piston 22 and is supported by a planar spring 12 on the lower side of the cylinder 20. The planar spring 12 linearly oscillates within its range of elastic deformation. The displacer 32 is configured to include the regenerator 40 therein.

A compression space 30*a* is provided between the piston 22 and the displacer 32, for compressing the gas by the combined movement of the piston 22 and the displacer 32. An expansion space 30*b* is provided on the front inner side of a finger tube 14 for expanding the gas.

A reciprocating device in the form of a cooler may perform cryogenic refrigeration, and therefore cannot use a lubricant having a liquid component. Also, since the respective elements of the device are regeneration-hardened and are thus brittle, the moving parts such as the piston 22, the displacer 32 and the like should be coaxially positioned. If the moving parts are not concentrically (or coaxially) positioned, the piston 22 and the displacer 32 may frictionally contact the cylinder 20 and the displacer housing 30. The frictionally contacting portion is thus worn away with use, resulting in the fracture and failure of the product.

In order to solve the aforementioned problem, a gas bearing method has been provided that uses a working gas. In this method, the working gas serves as a lubricant of the moving parts, such as the piston 22 and the displacer 32. Specifically, while the working gas is compressed, the gas bearing method allows a small amount of working gas to be injected, and thus the injection pressure of the working gas prevents the piston 22 and the displacer 32 from frictionally contacting the cylinder 20 and the displacer housing 30.

However, according to the aforementioned gas bearing lubrication method, since the pressure of the injection gas is very low, it is very important to precisely align the concentrically arranged moving parts during the assembly process. In particularly, unlike the piston which is centered by the magnetic field of the linear motor 50, the displacer 32 is moved only by the interaction of the working gas and the planar spring 12 and receives a weak supporting force from the gas bearing, thus it is difficult to maintain a precise concentric state.

Due to the aforementioned difficulty, in the conventional manufacturing process of a linear reciprocating device, the centering process for aligning the center of the displacer 32 with the center of the displacer housing 30 is performed after the installation of the displacer 32.

The known centering process is performed in the following sequence. First, the displacer rod 321 is coupled with the planar spring 12. Afterwards, a protruded end of the displacer rod 321 penetrating the planar spring 12 is moved in the x-axis direction and the y-axis direction (which are both perpendicular to the axial direction of the displacer rod 321) such that the displacer 30 is aligned with the center line of the displacer housing 30. In particular, the displacer rod 321 is fixed after penetrating the piston 22 and the planar spring 12.

After the centering process, the planar spring 12 is coupled with a spring fixing part 11 (also referred to as a "spring standoff") inside of the sealing container 10, thereby completing the installation operation of the displacer 32.

The conventional centering process using the protruded end of the displacer rod 321 must be performed after the displacer rod 321 is coupled with the planar spring 12. Thus, a jig (known in the art) performing a centering operation must move a considerable amount, since the end of the displacer rod is located a considerable distance from the "origin" from which the "moment arm" (displacer rod 321) extends, thereby potentially reducing the accuracy of the centering process. Additionally, since the displacer rod 321 often protrudes beyond the spring 12 by only a small amount, it is often difficult to apply the jig. As a result, the precision of the process of centering the displacer 32 is lowered and the manufacturing efficiency of the device is reduced.

In addition, after completion of the centering process, the planar spring 12 must be coupled with the spring standoff 11. Hence, the control of the position of the displacer rod 321 is allowed only when the screw holes 11*a* of the planar spring 12 and the holes of the spring standoff 11 are not registered in line with each other to some degree (i.e., a degree of aligning freedom is required). As a result, since the freedom movement of the displacer rod 321 is very low, it is difficult to efficiently align the concentric positioning of the reciprocating parts.

SUMMARY OF THE INVENTION

Accordingly, the present invention is directed to provide a spring standoff for centering a reciprocating rod that substantially obviates one or more problems due to limitations and disadvantages of the related art.

It is a benefit of the invention to provide a reciprocating device to which a spring standoff having an open wall portion is provided, thereby improving the efficiency of the centering process.

Additional advantages, objects, and features of the invention will be set forth in part in the description which follows and in part will become apparent to those having ordinary skill in the art upon examination of the following, or may be learned from practice of the invention. The objectives and other advantages of the invention may be realized and attained by the structure particularly pointed out in the written description and claims hereof as well as the appended drawings.

A reciprocating device of the present invention includes a sealing container, a reciprocating rod positioned within the sealing container; a planar spring connected to the displacer rod, and a spring standoff provided on one end of the sealing container and coupled with the planar spring, the spring standoff having a window in a circumferential surface thereof.

Additionally, the reciprocating device may further include a cylinder inside the sealing container and filled with a gas, a displacer housing provided at one end of the sealing container, a displacer configured to divide an inside of the displacer housing, a piston configured to move together with the displacer, the piston and the displacer configured to at least one of compress and expand the gas, a motor configured to drive the piston, and a regenerator configured to at least one of store and radiate thermal energy. The reciprocating rod may be positioned at an end of the displacer.

In a further feature of the invention the opening window includes a plurality of opening windows arranged at generally the same interval. Further, the opening window may have a generally rectangular, round, polygonal or oval configuration.

The present invention also provides a method for performing a centering process of a displacer of a cooler, that includes inserting the reciprocating rod into a housing of the reciprocating device, coupling a planar spring with a spring standoff, inserting a jig through a window in a circumferential surface of the spring standoff, centering the reciprocating rod, and coupling the reciprocating rod with the planar spring.

An additional feature of the invention provides a spring standoff for a reciprocating device, and having a generally cylindrical body and including a window in a circumferential surface of the body, and a flange at each end of the body, one flange configured to be coupled to a planar spring of the reciprocating device, and the other flange configured to be coupled to a sealing container of the reciprocating device. The body may be configured to generally concentrically house at least a portion of a reciprocating rod coupled to the planar spring of the reciprocating device.

In an additional feature of the invention, the opening window may have a generally a generally rectangular, round, polygonal or oval configuration. Additionally, at least three opening windows may be provided in the spring standoff.

According to the structure of the cooler according to the present invention, and the centering process of the displacer in the cooler, the centering operation can be performed more conveniently and easily.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE INVENTION

Figure 1:
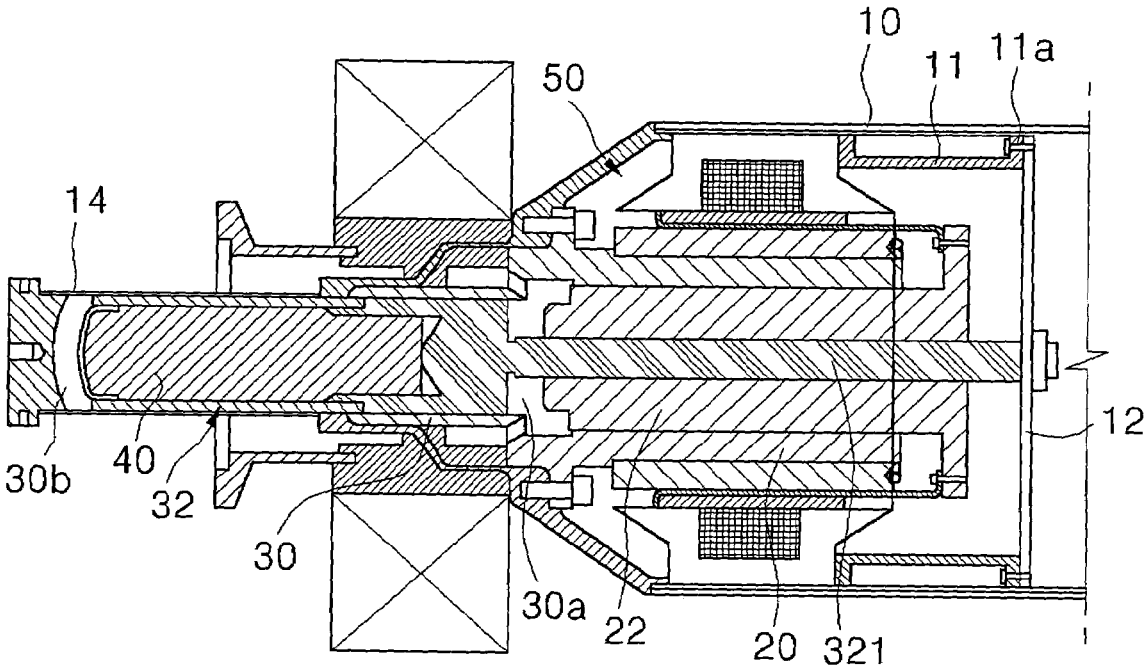
FIG. 1 (Background Art)
FIG. 1 is a sectional view of a conventional reciprocating device.
Figure 2:
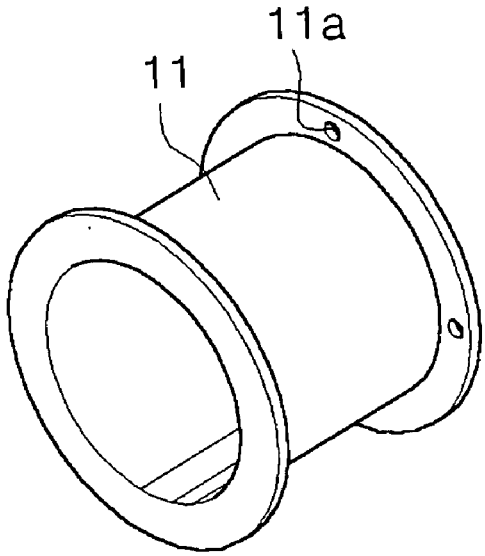
FIG. 2 (Background Art)
FIG. 2 is a perspective view of a spring standoff applied to the conventional reciprocating device.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. For example, it is readily appreciable by those skilled in the art that the present invention is applicable to a wide variety of reciprocating or oscillating devices and mechanisms.

A reciprocating device of the present invention has a configuration in which a spring standoff is connected to a planar spring. The spring standoff has an opening window formed in an external circumference thereof, and is provided at one end of a housing of the reciprocating device.

Reference will now be made in detail to the preferred embodiments of the present invention, examples of which are illustrated in the accompanying drawings. Wherever possible, the same reference numbers will be used throughout the drawing to refer to the same or like parts.

Figure 3:
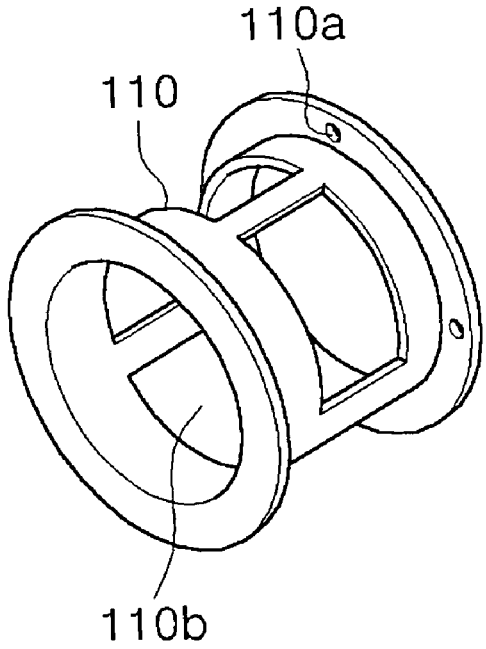
FIG. 3 is a perspective view of a spring standoff of a reciprocating device according to an embodiment of the present invention.

Referring to FIG. 3, a reciprocating device according to an embodiment of the present invention includes a generally cylindrical spring standoff 110 having flanges formed at both ends thereof such that one end can be coupled with a sealing container 10 and the other end can be coupled with a planar spring 12.

As shown in FIG. 3, the spring standoff 110 has a plurality of opening windows 110*b* formed at the external circumference thereof with a configuration such that central portions of the body are open.

The opening windows 110*b* are generally arranged at the same interval and in the same shape. In FIG. 3, although only the three opening windows are shown, the number is not limited to three, as more or fewer opening windows may be provided.

In addition to the rectangular shape shown in FIG. 3, the opening windows 110*b* may have the shape of a circle, polygon, oval or the like.

Next, a manufacturing method of a reciprocating device according to one embodiment of the present invention will be described. The manufacturing method of the present invention is different in the adjustment of the concentric arrangement of the displacer when compared with the conventional manufacturing method of a reciprocating device. The adjusting of the concentric relationship is hereinafter described in more detail with reference to FIGS. 1 and 3.

First, displacer 32 is inserted into displacer housing 30. Thereafter, the planar spring 12 is not coupled with displacer rod 321, but is first coupled with the spring standoff 110.

Subsequently, a jig is inserted through the opening windows 110*b* and the centering process for the displacer 32 is then performed. After the centering process is completed, a protruded end of the displacer rod 321 is fastened with the planar spring 12.

In other words, after the concentricity of the displacer 32 is adjusted by the jig, the displacer rod 321 and the planar spring 12 are connected to each other.

According to the embodiment of the present invention described as above, since the distance between the acting point of the jig on the displacer rod 321, and the displacer 32 is shortened, the precision of the centering process is enhanced, since the jig and the displacer rod are moved a shorter distance during the centering process. Further, by inserting the jig though an opening window 110*b*, the jig can more securely engage the displacer rod 321 than it would if the jig were to engage an end of the displacer rod protruding from the planar spring 12.

In addition, since the displacer rod 321 and the planar spring 12 are not connected to each other prior to performing the centering process, the displacer rod 321 is able to more freely move during the centering process, thereby allowing easier alignment of the concentric arrangement of the displacer 32.

As described above, the reciprocating device according to the invention permits the centering process of the displacer to be easily performed by using the structure of the spring standoff having an open side wall portion.

Further, since the precision of the centering process is high, productivity and work efficiency are enhanced.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A reciprocating device comprising:

a sealing container;

a reciprocating rod positioned within said sealing container;

a planar spring connected to the displacer rod; and a spring standoff provided on one end of the sealing container and coupled with said planar spring, said spring standoff having a window in a circumferential surface thereof.

2. The reciprocating device according to claim 1, further comprising:

a cylinder inside said sealing container and filled with a gas;

a displacer housing provided at one end of said sealing container;

a displacer configured to divide an inside of said displacer housing;

a piston configured to move together with said displacer, said piston and said displacer configured to at least one of compress and expand the gas;

a motor configured to drive said piston; and a regenerator configured to at least one of store and radiate thermal energy;

wherein the reciprocating rod is positioned at an end of the displacer.

3. The reciprocating device according to claim 1, wherein said window comprises a plurality of windows positioned at generally the same interval.

4. The reciprocating device according to claim 1, wherein said window has one of a generally rectangular, round, polygonal and oval configuration.

5. A method for performing a centering process of a reciprocating rod of a reciprocating device, the method comprising:

inserting the reciprocating rod into a housing of the reciprocating device;

coupling a planar spring with a spring standoff;

inserting a jig through a window in a circumferential surface of the spring standoff;

centering the reciprocating rod; and coupling the reciprocating rod with the planar spring.

6. A spring standoff for a reciprocating device, the standoff having a generally cylindrical body and comprising:

a window in a circumferential surface of said generally cylindrical body; and a flange at each end of said generally cylindrical body, one said flange configured to be coupled to a planar spring of the reciprocating device, and the other said flange configured to be coupled to a sealing container of the reciprocating device;

wherein said generally cylindrical body is configured to generally concentrically accommodate at least a portion of a reciprocating rod coupled to the planar spring of the reciprocating device.

7. The spring standoff according to claim 6, wherein said window has one of a generally rectangular, round, polygonal and oval configuration.

8. The spring standoff according to claim 6, wherein said window comprises at least three windows.

* * * * *